United States Patent [19]

Clausen et al.

[11] Patent Number: 4,636,109

[45] Date of Patent: Jan. 13, 1987

[54] HINGED SLALOM GATE

[75] Inventors: Eivind Clausen, Bellingham, Wash.; Timothy J. Skaling, Dana Point, Calif.

[73] Assignee: Allsop, Inc., Bellingham, Wash.

[21] Appl. No.: 685,135

[22] Filed: Dec. 21, 1984

[51] Int. Cl.[4] ..... E01F 9/01

[52] U.S. Cl. ..... 404/10; 116/63 P; 40/608; 40/612; 52/113; 52/155; 248/156; 248/160

[58] Field of Search ..... 404/6, 9, 10, 11; 116/63 R, 63 P; 40/606, 608, 612; 248/156, 160; 52/113, 155, 165

[56] References Cited

U.S. PATENT DOCUMENTS

| | | | |
|---|---|---|---|
| 1,224,926 | 5/1917 | Hindmarsh | 52/155 |
| 1,726,817 | 9/1929 | Franklin | 404/10 X |
| 1,939,968 | 12/1933 | Frei, Jr. | 52/113 |
| 2,141,067 | 12/1938 | Miller | 52/113 |
| 2,286,959 | 6/1942 | Haines | 404/10 X |
| 2,775,221 | 12/1956 | Olson | 40/606 |
| 2,779,240 | 1/1957 | Gaydos | 404/9 X |
| 2,976,000 | 3/1961 | Gunderson | 248/156 |
| 3,141,534 | 7/1964 | Dunston | 52/165 X |
| 4,270,873 | 6/1981 | Laehy et al. | 404/10 |
| 4,491,438 | 1/1985 | Berutti | 404/10 |

FOREIGN PATENT DOCUMENTS

| | | | |
|---|---|---|---|
| 1484565 | 7/1969 | Fed. Rep. of Germany | 52/155 |
| 2238864 | 2/1974 | Fed. Rep. of Germany | 404/10 |

*Primary Examiner*—Stephen J. Novosad
*Assistant Examiner*—John F. Letchford
*Attorney, Agent, or Firm*—Hughes & Cassidy

[57] ABSTRACT

A slalom gate which has a lower support member adapted to be inserted into the snow. There is a retractable anchoring member mounted in the support member, in a manner that downward deflection of the post about a lower pivoting connecting portion pulls the anchor member upwardly to cause it to expand outwardly into the snow, thus resisting retraction of the support member from the snow. When the gate returns to its upright position, the anchoring member retracts so that the gate can more easily be removed from the snow.

16 Claims, 6 Drawing Figures

FIG. 3
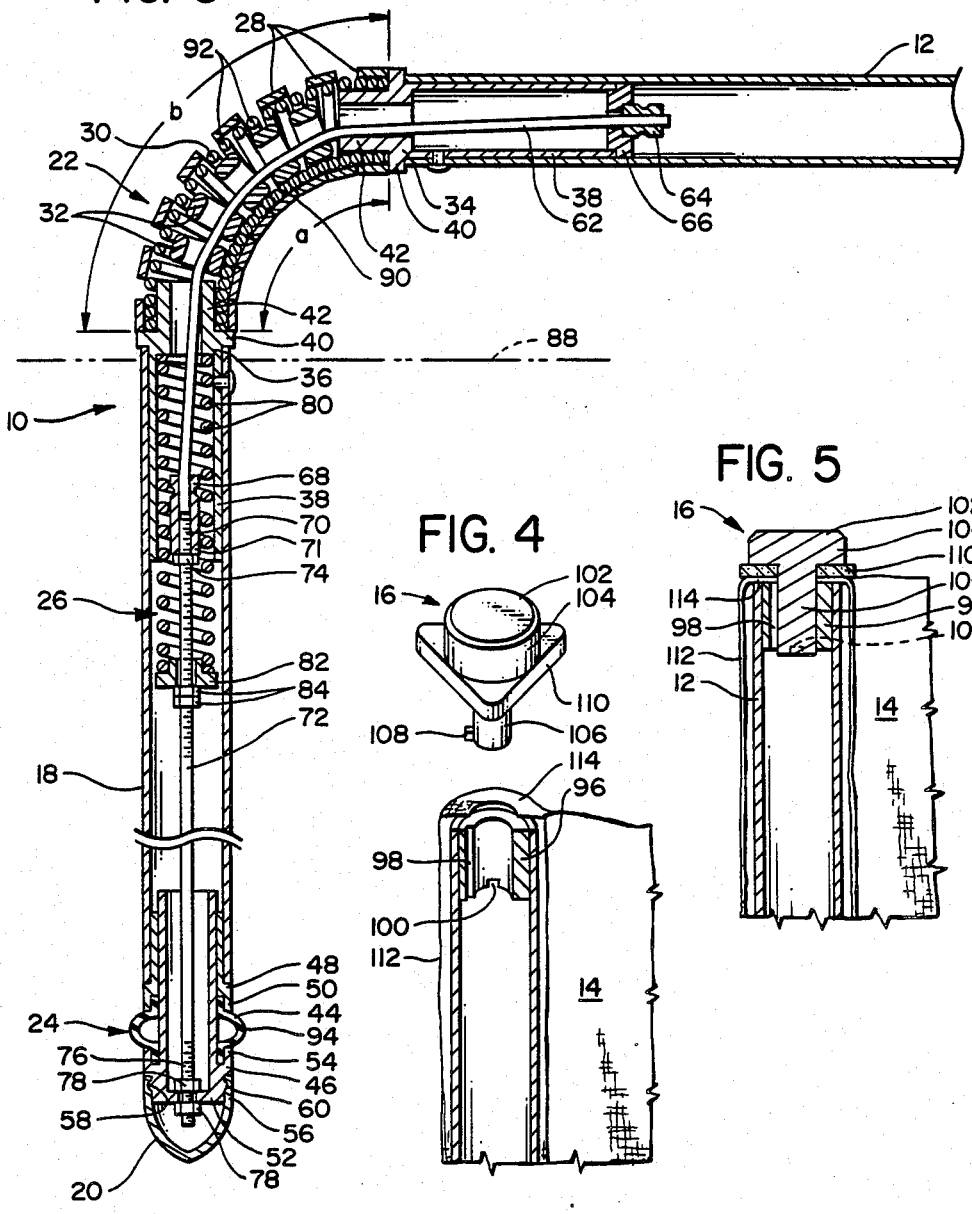
FIG. 4
FIG. 5
FIG. 6
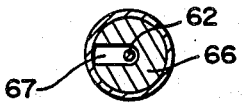

HINGED SLALOM GATE

BACKGROUND OF THE INVENTION

1. Field of the Invention

The present invention relates to a deflectable post, which in the preferred form is a slalom gate for skiing, where the post is adapted to be inserted into a base material, such as snow, and which can pivot upon encountering an impacting force; and the present invention relates more particularly to an improved anchoring means for retaining the post in the base material.

2. Background Art

Slalom gates are commonly used for snow ski racing, and the slalom gate typically comprises an elongate post which has a lower support portion which is pushed into the snow, an intermediate bendable connecting portion, and an upright main post portion carrying a flag or other indicating device thereon. When a skier accidentally comes in contact with the gate, the post which makes up the major part of the gate deflects downwardly, with the bendable connecting portion being the pivot location for the downward movement. After the impact, a biasing or spring means in the connecting portion causes the post or gate to return to its upright position.

One of the problems with such slalom gates is that it sometimes happens that the impact on the gate is sufficient to exert a substantial force to pull the gate out of the snow. On the other hand, it is desirable to have the gate be made so that the lower support end can easily be driven into the snow or withdrawn therefrom, primarily for ease of handling.

A search of the patent literature discloses a variety of stabilizing devices such as traffic indicators, boundary markers, sign posts, etc. where the post or signal device is anchored at a ground location and has a resilient pivoting connecting member which permits the post or stabilizing device to deflect downwardly. These will be described briefly below U.S. Pat. No. 4,270,837, Leahy et al, shows a pivoting post where there is a spring that pulls the upper section into an upright position after the marker has been struck.

U.S. Pat. No. 4,197,807, Campbell, shows a marker that is formed of a resilient material.

U.S. Pat. No. 4,106,879, Diedershagen et al, shows a resilient base that swings the marker to an upright position. There are some flared members which tend to keep the member in the ground.

U.S. Pat. No. 4,004,545, O'Donnell, shows a spring loaded deflectable member where the base is flat and is secured to a ground location.

U.S. Pat. No. 3,838,661, Medley Jr., shows a spring loaded post which moves back to the upright position. There is a cable which keeps the spring from being overstretched.

U.S. Pat. No. 3,485,201, Kelley, has a resilient loop 14 which carries the post back to its upright position.

U.S. Pat. No. 3,478,714, Keats, illustrates a spring loaded post having a number of ring members at the pivot point.

U.S. Pat. No. 3,442,187, Hausegger, shows a coil-like compression spring which returns the post to its upright position.

U.S. Pat. No. 2,976,000, Gunderson, shows a road sign with a spring loaded flex joint at the base.

A number of other patents show deflectable posts which are believed to be no more relevant than those discussed above, so no detailed comments will be added on these. These are: U.S. Pat. No. 2,949,324, Birge et al; U.S. Pat. No. 2,141,067, Miller; U.S. Pat. No. 2,103,410, Frei, Jr.; U.S. Pat. No. 1,939,968, Frei, Jr.; U.S. Pat. No. 1,284,376, Lehman; U.S. Pat. No. 924,342, Johnson.

The search also disclosed several patents relating to earth anchors of various types. While these are not considered to be directly relevant to the present invention, these are disclosed to insure that there is a full disclosure of all possibly relevant art. These patents are as follows:

U.S. Pat. No. 3,4270,468, Debiton, illustrates a device having an expandable envelope surrounding an anchor pin. This is inflated by fluid pressure to hold it in the earth.

U.S. Pat. No. 1,224,926, Hindmarsh, shows an earth anchor where there is a threaded rod that is moved upwardly. This causes the lower part of the post to expand so as to anchor it into the earth.

U.S. Pat. No. 1,133,496, Noakes, shows an earth anchor where a cable will pull on a pair of members that are pivoted to one another in a manner to cause these to extend outwardly into an earth-engaging position.

SUMMARY OF THE INVENTION

The post assembly of the present invention is adapted to be inserted into a base material, such as snow, and which can pivot upon encountering an impacting force, while being retained in the base material.

The post assembly comprises a lower support member adapted to be inserted into the base material and withdrawn therefrom, with the support member having an upper end and a lower end. There is a main post member comprising an upper main post portion and a lower connecting portion. The post member has a lengthwise axis, and the connecting portion is bendable so as to permit said main post portion to pivot laterally about the connecting portion from a normal upright position to a downward deflected position. The connecting member is biased to urge the post member to the normal upright position.

There is a retractable anchoring member mounted to the support member. The anchoring member has a retracted position which permits said post assembly to be inserted into, or withdrawn from, the base material with relatively less force, and an extended position where the anchoring member extends into the base material to resist movement of the support member from the base material.

There is actuating means operatively connected between the anchoring member and the main post member in a manner to be responsive to movement of the main post member so that lateral movement of the post member from the upright position causes the anchoring member to move to the extended position.

Thus, the support member in its upright position can be inserted into or removed from the base material with relative ease. Further, when the main post portion is deflected under impact loading, the anchoring member moves to the extended position to resist movement of the support member from the base material.

In the preferred form, the actuating means comprises an actuating end portion operatively connected to the anchoring member. The actuating means and the anchoring member are arranged so that upward movement of the actuating end portion resulting from deflection of the post member moves the anchoring member to its extended position.

The preferred form of the anchoring member is that it is an axially compressible member which, when axially compressed, expands outwardly to the extended position. Upward movement of the actuating end portion causes axial compression of the compression member.

Preferably, the actuating means comprises cable means extending upwardly from the support member through the connecting portion and connecting to the post portion. The connecting portion is arranged so that deflection of the connecting portion causes the connecting portion to be extended linearly so as to pull said cable means upwardly in said support member.

Further, the actuating means comprises spring means to urge the actuating end portion downwardly, and also to urge the cable means downwardly, thus causing the connecting portion to be biased toward the normal upright position. Desirably, the cable means has an upper end removably mounted to a connecting member that is in turn mounted to said main support member. The preferred form is that the connecting member has a through opening to accommodate the cable means, and a lateral slot through which said cable means can be removed from the connecting member.

Preferably, the actuating means comprises a threaded rod member having an upper end releasably connected to a lower end of the cable means. The rod member has a lower end portion which comprises the actuating end portion.

Other features of the present invention will become apparent from the following detailed description.

BRIEF DESCRIPTION OF THE DRAWING

FIG. 3 is a view similar to FIG. 2, that is showing the post of the present invention deflected laterally so as to move the anchoring member to its extended position;

FIG. 4 is an isometric view, partly in section, illustrating a connecting device to secure a flag to the upper end of the post;

FIG. 5 is a longitudinal sectional view showing the upper end of the pole and the connecting device for the flag; and FIG. 6 is a sectional view taken on line 6—6 of FIG. 2.

DESCRIPTION OF THE PREFERRED EMBODIMENT

Figure 1:
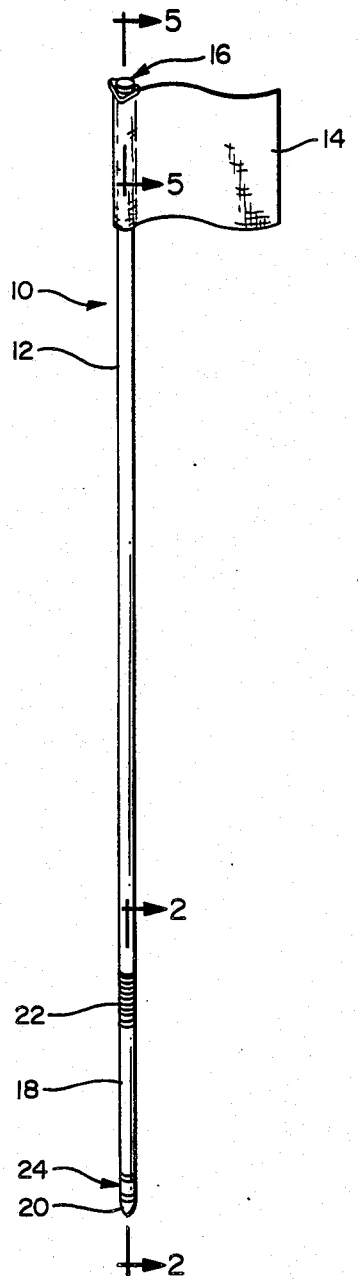
FIG. 1 is an isometric view of the present invention.

The present invention is described as being incorporated in a slalom gate 10 that is used for snow ski racing. This gate 10 comprises a main post 12 having an elongate cylindrical configuration and having a longitudinal or lengthwise center axis. A flag 14 is mounted to the upper end of the post 12 and is held in place by an upper securing device 16. The gate further comprises a lower elongate support member 18 having a generally cylindrical cross-sectional configuration substantially the same as that of the post 12 and having a pointed end portion 20 adapted to be driven into the snow. There is a bendable connecting member 22 interconnecting the support member 18 and the main post 12.

Mounted to the lower end of the support member 18 is an expandable and retractable anchoring member 24 having a retracted position (shown in FIG. 2) and an extended or expanded position (shown in FIG. 3). There is an actuating assembly 26 operably connected between the anchoring member 24 and the post 12. As will be described more fully hereinafter, this actuating assembly 26 causes the anchoring member 24 to move to its extended position upon downward deflection of the main post 12.

To describe the components of the present invention in more detail, the connecting member 22 comprises a plurality of cylindrical hinge rings, stacked one upon the other. Each of these hinge rings 28 is formed as a relatively shallow cylinder, and with the gate 10 in its upright (i.e. non-deflected) position, these hinge rings 28 substantially enclose the connecting member 22.

Positioned within the hinge rings 28 is a hinge spring 30 in the form of a helical coil positioned within the hinge rings 28. Within the hinge spring 30 is a second set of hinge rings 32 stacked one upon the other.

Positioned at the upper and lower ends of the connecting member 22 are upper and lower mounting members 34 and 36. Each of these mounting members 34–36 comprises a mounting sleeve 38 which is connected to an annular outwardly extending circumferential flange 40 and also connected to an inner sleeve 42. The mounting sleeve 38 of the upper mounting member 34 fits within the lower end of the main post 12, while the mounting sleeve 38 of the lower mounting member 36 fits within the upper end of the support member 18. The two annular flanges 40 of the two mounting members 34 and 36 engage the uppermost and lowermost hinge rings 28, respectively and also engage the upper and lower ends of the hinge spring 30. The two inner sleeves 42 engage the uppermost and lowermost inner hinge rings 32, respectively.

The anchoring member 24 comprises a cylindrical rubber sleeve 44 mounted to a sleeve member 46 which is in turn slide mounted to a second sleeve member 48 which is in turn mounted to the lower end of the support member 18. The lower end of the second sleeve member 48 has an outwardly stepped mounting ring or flange 50 which engages the upper end of the rubber sleeve 44. The lower end of the sleeve member 46 is formed with an end plate 52 which is likewise formed with an outwardly stepped circumferential ring or flange 54 to engage the lower end of the rubber sleeve 44.

The pointed end portion 20 is formed as an end cap having an upper cylindrical portion fitting around the lower end plate 52. The cylindrical portion 56 has an inner circumferential groove 58 which forms a snap fit with a circumferential bead or lip 60 formed on the outer surface of the end plate 52. The upper edge of the cylindrical portion 56 is spaced downwardly a short distance from the flange 54 to permit insertion of a screwdriver or other instrument to remove the end cap 20.

The actuating assembly 26 comprises an upper flexible cable 62 attached at its upper end to a clamp ring 64 which in turn is mounted to a circular mounting plate 66 that engages the upper end of the sleeve 38 of the upper mounting member 34. The plate 66 is formed with a radial slot 67 to receive the cable 62 and a cylindrical recess 69 to retain the clamp ring 64. The cable 62 extends downwardly from the plate 66 through the center of the connecting member 22 (i.e. through the inner hinge rings 32) to terminate at a lower crimp sleeve 68 to which the cable 62 is securely connected. The crimped sleeve 68 has a lower threaded socket portion 71 which is in turn connected to an upper end 70 of a threaded rod 72. A lock nut 74 bears against the crimp sleeve 68 to hold the rod 72 securely connected to the crimp sleeve 68.

The lower end 76 of the rod 72 extends through an opening in the lower end plate 52 and is securely engaged to the end plate 52 by means of a pair of nuts 78. There is a coiled compression spring 80 surrounding the upper portion of the rod 72 and the lower end of the cable 68. The upper end of this spring 80 engages the lower end of the inner sleeve 42 of the lower mounting member 36, and the lower end of the compression spring 80 bears against a circular retaining plate 82 mounted to the rod 72 a short distance downwardly from the upper end thereof. A pair of nuts 84 are threaded onto the rod 72 and are positioned below the retaining plate 82 to hold the retaining plate 82 in place.

The action of the compression spring 80 is to push the plate 82 and the rod 72 downwardly in the support member 18, with the downward movement of the rod 72 being limited by the cable 62 which is in turn attached to the clamp ring 64 and plate 66. With the post 12 in the upright position of FIG. 2, the length of the cable 62 and the rod 72 are such that the sleeve member 46 is at a downward position so that the rubber sleeve 44 has its outer surface 86 substantially cylindrical and the same size as a outer surface of the support member 18.

Figure 2:
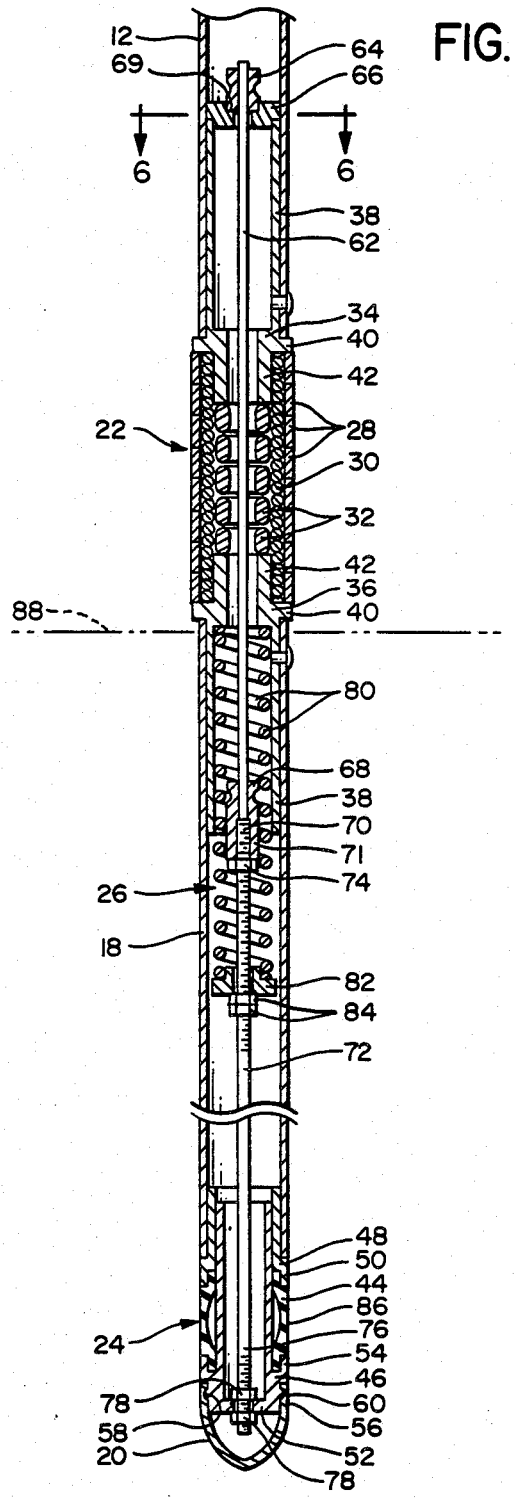
FIG. 2 is a longitudinal sectional view taken along Line 2—2 of FIG. 1.

To describe the overall operation of the present invention, with the components of the slalom gate 10 assembled, the compression spring 80 causes the connecting member 22 to be positioned so as to maintain the main post 12 and the support member 18 in axial alignment, as shown in FIGS. 1 and 2. In this position, the gate 10 can be handled in a conventional manner and can be inserted in the snow by pushing the gate 10 downwardly with the support member 18 penetrating into the snow which acts as the base material to support the gate 10. Normally, the support member 18 will be pushed into the snow a distance so that the connecting member 22 will be at or about the snow level (indicated in FIGS. 2 and 3 by the broken line 88).

Let it be assumed that a skier is passing close to the gate 10 and impacts the gate 10. The flexible connecting member 22 will permit the main post 12 to yield upon impact and tilt downwardly, as illustrated in FIG. 3. When this happens, as can be seen in FIG. 3, the inner portions of the hinge spring 30 (indicated at 90 in FIG. 3) remain in contact with one another so that the linear distance (indicated at "a") of the inside surface 90 of the rings 28 remains substantially constant. However, the outside portions 92 of the hinge springs 30 are separated as the outer portion of the spring 30 move away from one another. Thus, the linear distance (indicated at "b") of the outside spring portions 92 becomes extended. In like manner, the center axis of the connecting member 22 becomes extended linearly.

The effect of this is that the lower end of the cable 62 pulls the rod 72 upwardly, thus compressing the rubber sleeve 44. This causes the rubber sleeve to expand outwardly as at 94 to extend into the snow, thus anchoring the lower end of the support member 18 in the snow. When the impacting force on the post 12 is removed, the action of the compression spring 80 pushes the lower end tip portion 20 downwardly into the snow, and at the same time the rubber sleeve 44 is no longer axially compressed to that it moves back to its cylindrical or retracted position, as shown in FIG. 2. Further, the action of the spring 80 moves the pole 12 to the upright position.

When it is desired to pull the gate 10 out of the snow, it is a simple matter to pull upwardly on the post 12, with the retractable anchoring member 24 offering no substantial resistance.

The aforementioned flag securing device 16 will now be described with reference to FIGS. 4 and 5. An upper retaining sleeve 96 is positioned in the upper end of the post 12 and secured thereto by suitable means (e.g. a bonding agent). This retaining sleeve 96 has a vertical slot 98 and a short recess 100 formed in the lower edge of the sleeve 96 at a location spaced angularly from the slot 98. There is a releasable retaining member 102 having a knob 104 and a downwardly extending shank 106. There is a finger 108 extending laterally from the lower end of the shank 106. A triangularly shaped compressible insert 110 is positioned around the shank 106 and is located just below the knob 104. The corners or apex portions of the insert 10 protrude outwardly to prevent sliding of the gate 10 on icy snow.

The flag 14 has a cylindrical sleeve portion 112 which fits around the upper end of the post 12, and this sleeve portion 112 has an inturned cloth portion 114 at its upper end. When the sleeve portion 112 is placed over the upper end of the post 12, the retaining member 102 is moved downwardly so that the shank 106 moves into the socket provided by the sleeve 96, with the finger 108 passing through the slot 98. When the knob 104 is depressed downwardly so as to compress the insert 110 moderately, the finger 108 is positioned below the lower end of the sleeve 96, and the knob 104 can be rotated so as to move the finger 108 into alignment with the retaining recess 100. With the finger 108 in the retaining recess 100, the retaining member 102 is held securely in place to in turn hold the flag 14 securely in place.

One of the advantageous features of the present invention is that the gate 10 can be easily disassembled and assembled for repair or replacement of parts. For example, the end cap 20 can be removed and the lower nut 78 unthreaded, after which the sleeves 46 and 48 and also the rubber sleeve 44 can be removed. Further, the rod 72 can easily be removed from the threaded portion 69 of the crimp ring 68 so as to take the tension off of the cable 62. Further, it is readily apparent from examining FIG. 2 that the support member 18 and the various components positioned thereabove can be easily removed from main pole portion 12. Also, the securing device can easily be disassembled by depressing the knob 104 downwardly and moving the finger 108 upwardly through the slot 98.

It is to be recognized that various modifications could be made to the present invention without departing from the teachings thereof.

What is claimed is:

1. A post assembly which is adapted to be inserted into a base material, such as snow, and which can pivot upon encountering an impacting force, while being retained in said base material, said post assembly comprising:

a. a lower support member adapted to be inserted into said base material and withdrawn therefrom, said support member having an upper end and a lower end;

b. a main post member comprising an upper main post portion and a lower connecting portion operatively connected to said base member, said post member having a lengthwise axis, said connecting portion being bendable so as to permit said main post portion to pivot laterally about the connecting portion from a normal upright position to a downward deflected position, said connecting portion being biased to urge said post member to said normal upright position;

c. a retractable anchoring member mounted to said support member, said anchoring member having a retracted position which permits said post assembly to be inserted into, or withdrawn from, said base material with little force, and an extended position where said anchoring member extends into said base material to resist movement of said support member from said base material;

d. actuating means operatively connected between said anchoring member and said main post member in a manner to be responsive to movement of said main post member so that lateral movement of said post member from the upright position causes said anchoring member to move to the extended position;

whereby said support member in its upright position can be inserted into or removed from the base material with relative ease, and when said main post portion is deflected under impact loading, said anchoring member moves to said extended position to resist movement of said support member from the base material.

2. The post assembly as recited in claim 1, wherein there is at the lower end of the support member a removable lower end cap having a tongue and groove connection with said lower support member, said end cap enclosing a lower end portion of said actuating means, whereby removal of said end cap permits access to said actuating means for repair or replacement of components thereof.

3. The post assembly as recited in claim 1, wherein said post member has an upper end portion adapted to engage a single flag, said assembly having a retaining sleeve mounted within the upper end portion of the post, said retaining sleeve having a vertical slot and a lower recess spaced angularly from said slot, said assembly further comprising a retaining member having finger means movable downwardly through said slot and laterally to said recess, a compressible member mounted between said retaining member and said post, to urge said retaining member upwardly to a retaining position with said finger means in said recess.

4. The post assembly as recited in claim 3, wherein said compressible member extends outwardly from said post portion to provide protrusions adapted to engage a surface upon which said post assembly may come to rest so as to prevent further movement of said post assembly on said surface.

5. The post assembly as recited in claim 1, wherein said actuating means comprises:

a. a cable having an upper end mounted within said post portion and connected thereto, said cable extending downwardly through said connecting portion to said lower support member;

b. a rod member having an upper end operatively connected to a lower end of said cable, and a lower end operatively connected to said anchoring member;

c. said anchoring member being arranged so that upward movement of said rod resulting from deflection of said post member moves said anchoring member to its extended position;

d. a compression spring operatively engaging said rod member so as to urge said rod member downwardly to move said anchoring member to its retracted position and to urge said post portion to its upright position.

6. The post assembly as recited in claim 5, wherein said support member has a lengthwise axis, and said anchoring member comprises an axially compressible member which, when axially compressed, expands outwardly to said extended position, with upward movement of said rod member causing axial compression of said compression member.

7. The post assembly as recited in claim 5, wherein said rod member has a threaded engagement with a connecting member connected to a lower end of said cable, whereby said rod member can be detached from said cable, the upper end of said cable having a releasable connection to said post portion, said releasable connection comprising a connecting member having a radial slot through which said cable can be moved so as to disengage said cable from said connecting member, said rod member having a lower releasable connection to a connecting member which engages said anchoring member.

8. The post assembly as recited in claim 1, wherein said actuating means comprises an actuating end portion operatively connected to said anchoring member, said actuating means and said anchoring member being arranged so that upward movement of said acutating end portion resulting from deflection of said post member moves said anchoring member to its extended position.

9. The post assembly as recited in claim 8, wherein said support member has a lengthwise axis, and said anchoring member comprises an axially compressible member which, when axially compressed, expands outwardly to said extended position, with upward movement of said actuating end portion causing axial compression of said compression member.

10. The post assembly as recited in claim 9, wherein said actuating means further comprises cable means extending upwardly from said support member through said connecting portion and connecting to said post portion, said connecting portion being arranged so that deflection of said connecting portion causes said connecting portion to be extended linearly so as to pull said cable upwardly in said support member.

11. The post assembly as recited in claim 10, wherein said actuating means further comprises spring means to urge said actuating end portion downwardly, and also to urge said cable means downwardly, thus causing said connecting portion to be biased toward said normal upright position.

12. The post assembly as recited in claim 8, wherein said actuating means further comprises cable means extending upwardly from said support member through said connecting portion and connecting to said post portion, said connecting portion being arranged so that deflection of said connecting portion causes said connecting portion to be extended linearly so as to pull said cable upwardly in said support member.

13. The post assembly as recited in claim 12, wherein said actuating means further comprises spring means to urge said actuating end portion downwardly, and also to urge said cable means downwardly, thus causing said connecting portion to be biased toward said normal upright position.

14. The post assembly as recited in claim 13, wherein said cable means has an upper end portion removably mounted to a connecting member that is in turn mounted to said main post member.

15. The post assembly as recited in claim 14, wherein said connecting member has a through opening to accommodate said cable means, and a lateral slot through to rest so as to prevent further movement of said post assembly on said surface.

16. The post assembly as recited in claim 13, wherein said actuating means further comprises a threaded rod member having an upper end releasably connected to a lower end of said cable means, said rod member having a lower end portion which comprises said actuating end portion.

* * * * *